United States Patent [19]

Pitti

[11] 4,385,458

[45] May 31, 1983

[54] RESILIENT DEFLECTOR FOR SNOWPLOWS

[75] Inventor: Vincent J. Pitti, Norridge, Ill.

[73] Assignee: Flink Company, Norridge, Ill.

[21] Appl. No.: 296,339

[22] Filed: Aug. 26, 1981

[51] Int. Cl.[3] ..... E01H 5/06

[52] U.S. Cl. ..... 37/281

[58] Field of Search ..... 37/41, 42 R, 42 VL, 37/42 U, 50, 46, 281, 275; 172/816

[56] References Cited

U.S. PATENT DOCUMENTS

| | | | |
|---|---|---|---|
| 3,028,692 | 4/1962 | Brock | 37/50 X |
| 3,545,109 | 12/1970 | Boschung | 37/41 |
| 3,762,077 | 10/1973 | Henry et al. | 37/41 |
| 3,793,752 | 2/1974 | Snyder | 37/42 R |
| 3,808,714 | 5/1974 | Reissinger et al. | 37/42 UL |

*Primary Examiner*—E. H. Eickholt

*Attorney, Agent, or Firm*—Mason, Kolehmainen, Rathburn & Wyss

[57] ABSTRACT

A resilient deflector for snowplows tapers to a blunt edge as it extends outwardly from the top edge of the snowplow blade, generally across the entire length of the blade. By aligning the deflector with the snowplow blade working surface, the blade working surface area is extended, aiding in funnelling the snow outwardly of the blade and decreasing the tendency of the snow to billow rearwardly, over the blade, obscuring a snowplow operator's field of vision. Since the deflector is resilient its curvature may vary automatically in response to the plowing speed and the accumulation of snow on the snowplow blade working surface.

4 Claims, 5 Drawing Figures

FIG. 1
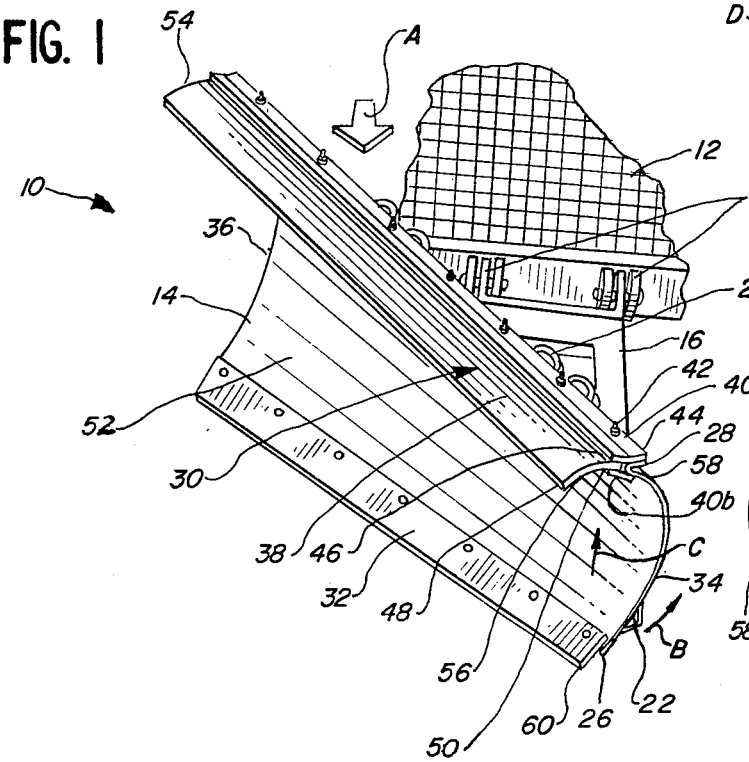
FIG. 2
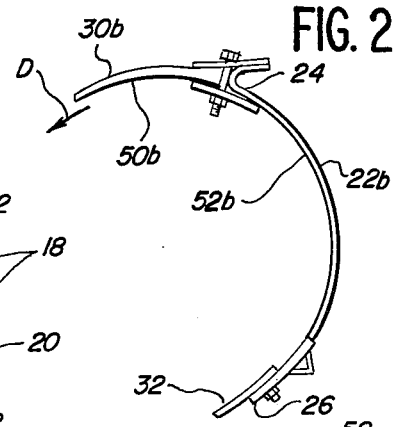
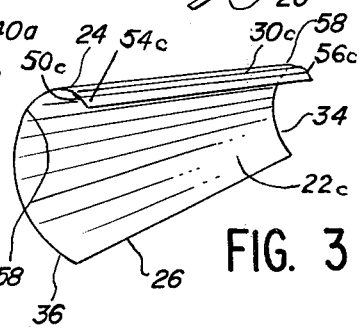
FIG. 3
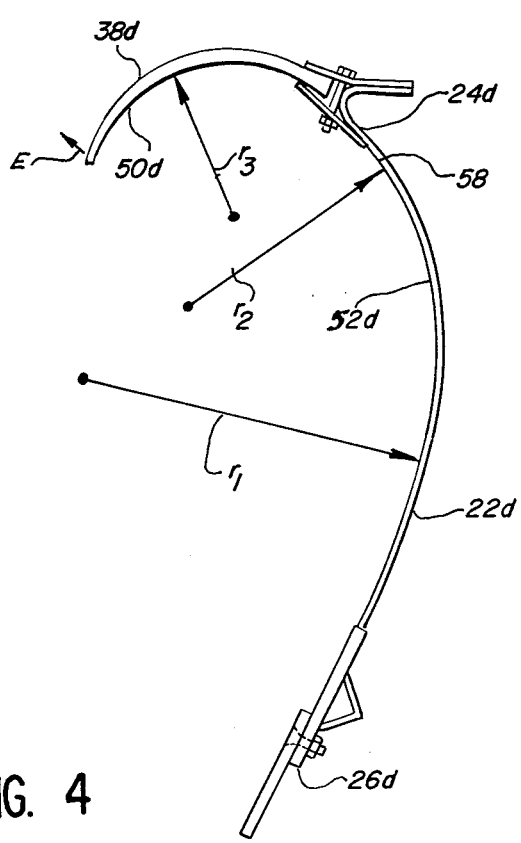
FIG. 4
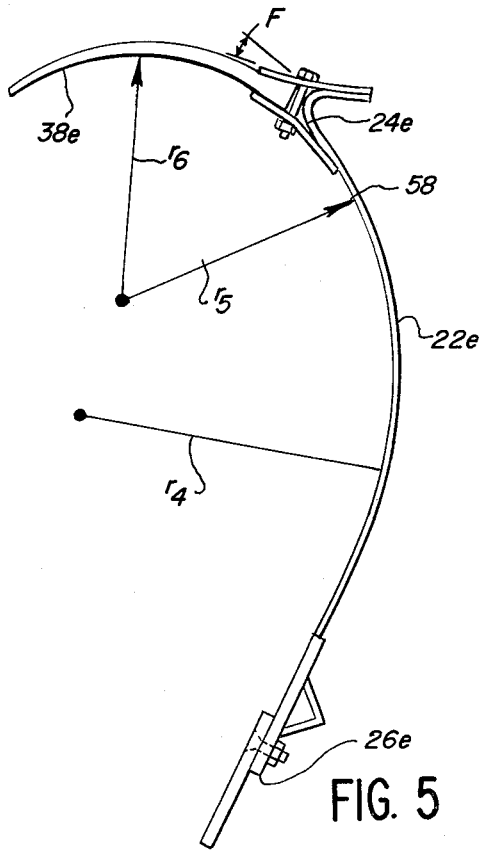
FIG. 5

RESILIENT DEFLECTOR FOR SNOWPLOWS

BACKGROUND OF THE INVENTION

1. Field of the Invention

This invention relates to snowplows, and particularly to snowplow deflectors.

2. Background of the Invention

Snowplow deflectors, also known a moldboard extensions, have been attached to upper edge of snowplows to increase the working surface of the plows and to thereby reduce the tendency of the plowed snow to blow onto the windshield of the vehicle. For example, U.S. Pat. Nos. 2,160,973 issued to Litchy and 2,103,775 issued to Frink disclose pivotally mounted boards attached atop a snowplow. These deflectors are not efficent under varied operating conditions and are inadequate in terms of operating life and vibration stability even under normal snowplow operating conditions. Under modern snowplowing practice roads are plowed frequently at high speeds before the snow accumulates. The high plowing speeds together with surface irregularities cause extreme vibrations to be generated in the snowplowing equipment. As a result, rigid deflectors are subject to premature vibration induced failure and also aggravate the already extreme vibrations experienced by the entire snowplow. Thus, the rigid deflectors, usually pivotally mounted, vibrate and chatter at high operating speeds or during severe weather conditions resulting in early failure both of the deflector and the entire snowplow assembly due to harmonic vibrations transmitted to the rest of the plowing apparatus from the deflector.

While some of these deflectors are adjustable from a position along the working surface of the snowplow blade to a retracted position in response to snow buildup they are generally not capable of adjusting their curvature gradually to adapt to varied conditions. As a result when plowing conditions are most severe the blades retract resulting in little improvement in visibility for the operator.

U.S. Pat. Nos. 3,429,059 and 3,413,738 relate to snowplows and U.S. Pat. Nos. 4,043,587 and 2,515,604 relate to flexible, automobile bug deflectors.

Despite many advances in the field of snowplow deflectors, the snow plowing art still lacks a deflector effective to control the flow of snow over the blade obscuring the operator's sight while increasing plowing efficiency by extending the working surface of the snowplow. In addition, the prior deflectors have a short working life. Moreover, the rigid deflectors, rather than aiding in the control of snowplow vibration in fact augment the vibrations experienced by the plow in use, thereby decreasing the efficiency and life of the entire plow assembly.

SUMMARY OF THE INVENTION

It is an object of this invention to provide a snowplow deflector of greater effectiveness in reducing snow blowback that obscures the operator's vision.

It is also an object of the present invention to provide such a snowplow deflector for diminishing the vibration experienced by the snowplow.

It is another object of the present invention to provide such a snowplow deflector for improving plowing efficiency.

It is still another object of the present invention to provide such a snowplow deflector having a long working life.

It is yet another object of the present invention to provide a snowplow deflector that automatically adjusts its curvature in use to the operating conditions of the snowplow.

It is also an object of the present invention to provide such a deflector for extending the working surface of the plow thereby increasing its ability to funnel snow from the surface to the side of the vehicle.

These and other objects of the present invention are achieved by a vehicular snowplow including a blade having a top edge and a bottom edge and a forward plowing surface between the top and bottom edges. The deflector is attached to the top edge extending along a substantial portion of the top edge. A tapered resilient portion of the deflector extends outwardly from the top edge of the blade over the forward plowing surface.

BRIEF DESCRIPTION OF THE DRAWING

These and other objects and other advantages of the present invention will become more apparent by reference to the following description taken in conjunction with the accompanying drawing wherein:

FIG. 1 is a partial, perspective view of one embodiment of the present invention attached to a vehicle;

FIG. 2 is an end elevational view of another embodiment of the present invention;

FIG. 3 is a perspective view of still another embodiment of the present invention;

FIG. 4 is an end elevational view of yet another embodiment of the present invention; and FIG. 5 is an end elevational view of another embodiment of the present invention.

DESCRIPTION OF THE PREFERRED EMBODIMENT

Referring to the drawing wherein like reference characters are used for like parts throughout, there is illustrated in FIG. 1 a snowplow 10 attached to the front of a vehicle 12. The snowplow 10 includes a blade 14 mounted on a push table 16 at an angle to the direction of forward movement, indicated by the arrow "A". Although any conventional push table 16 can be used, the illustrated push table 16 is pivotally mounted at 18 to enable the plow 10 to adjust vertically for variations in the surface being plowed. In addition, the blade 14 may be pivotally mounted on the push table 16 to permit the blade 14 to rotate in a counterclockwise, direction, indicated by arrow "B", when the plow 10 encounters curbs or other obstructions in its path. After the obstruction is passed the springs 20 (only partially shown) return the blade 14 to the position shown in FIG. 1.

The blade 14, shown as a one-way plow blade for illustration purposes only, includes a moldboard 22 having an upper edge 24 and a lower edge 26. The upper edge 24 is turned rearwardly creating a flange 28 and a deflector 30 is secured thereto. A conventional scraper 32 is bolted to the lower edge 26 of moldboard 22.

The deflector 30 includes a tapered, resilient deflector portion 38 secured along the upper edge 24 of the moldboard 22 by sandwiching it between the opposed angled plates 40 extending along the entire upper edge 24, held together by the bolts 42. Conveniently the rearward end 44 of the upper plate **40*a* is spot welded to the flange 28. Thus, the deflector portion 38 is clamped between the upper plate 40***a* and lower plate 40*b* by bolts 42.

The deflector portion 38 may be made of any resilient material including, for example, rubber, neoprene, urethane, or any other suitable natural or synthetic resilient material. The portion 38 tapers from a butt end 46 to a rounded tip 48. Although any desired rate of taper may be utilized to meet specific requirements; in the preferred embodiment, the taper slope is from 0.02 to 0.05 units of inward taper per unit of length. Similarly, the thickness and length of the portion 38 is amenable to considerable variation to meet specific requirements; however, in the preferred embodiment, the portion 38 is from 25 to 35 centimeters in length and varies in thickness from the butt end 46 having a thickness of about 1 to about 3 centimeters to the tip 48, having a thickness of from about 0.3 to about 1 centimeter. Thus the deflector 30 extends forwardly, over the forward plowing surface 52 of moldboard 22, well beyond the ground contacting edge 60 of plate 32.

The illustrated moldboard 22 is a conventional one-way plow moldboard having an inlet end 34 of smaller radius of curvature than the discharge end 36. The radius of curvature of the forward plowing surface 52 increases from the inlet end 34 to the discharge end 36 forming a frusto-conical or an oval frustrum segment.

The deflector 30 may be attached to a moldboard 22 of any conventional design, in addition to the one-way plows illustrated, including a conventional two-way plow (not shown) with a radius of curvature that increases from the midpoint of the moldboard 22 towards each end 34 or 36, the ends 34 and 36 having the same radius of curvature so that the blade has a V-shaped appearance. In addition, the deflector 30 may be used with moldboards 22 (not shown) whose radius of curvature does not vary from end 34 to end 36.

A deflector portion 38 mounted on a one-way plow moldboard 22 (FIG. 1) is preferably curved between its butt end 46 and tip 48. In addition, such a deflector portion 38 may have a forward plowing surface 50 radius of curvature that varies from its end 54 adjacent the discharge end 36 to the end 56 adjacent the inlet end 34 of the moldboard 22 at generally the same rate that the radius of curvature of the moldboard 22 varies over the same distance (FIG. 1) thereby also forming a frusto-conical or an oval frustrum segment forward plowing surface 50. Alternatively, the deflector 30*c*, mounted on a one-way plow moldboard 22*c*, may have a curved plowing surface 50*c* that does not vary in its radius of curvature from end 54*c* to end 56*c* (FIG. 3). Analogously, the deflector 30 utilized on a two-way plow moldboard (not shown) may have a radius of curvature varying from the center of the moldboard 22 to the ends 34, 36 as the radius of curvature of the adjacent portions of the moldboard 22 vary from the center of the moldboard to each end.

In general, the radius of curvature of the plowing surface 50 of the deflector portion 38 may be the same as or less than the radius of curvature of the adjacent portion 58 of the moldboard 22. However, in the preferred embodiments, the radius of curvature of the surface 50 is not greater than the radius of curvature of the adjacent portion 58 of the forward plowing surface 52 of the moldboard 22.

In a preferred embodiment, the plowing surface 52*b* of the moldboard 22*b* has a constant radius of curvature from edge 26 to edge 24 and the plowing surface 50*b* of the deflector 30 continues the same radius of curvature (FIG. 2). Thus, the surfaces 50*b* and 52*b* may take the form of a cylindrical or frusto-conical segment.

In another embodiment, the radius of curvature ($r$1, $r$2 in FIG. 4) of the plowing surface 52*d* of moldboard 22*d* decreases from lower edge 26 to upper edge 24 and the radius of curvature ($r$3) of the plowing surface 50*d* of the deflector portion 38 is even smaller than the radius of curvature of the immediately adjacent portion ($r$2) of the plowing surface 52*d* of moldboard 22. Thus the surface 52*b* takes the shape of an oval cylinder or an oval frustrum segment. The radius of curvature of the deflector portion 38 in this embodiment may either continue at the same decreasing rate of radius of curvature as the surface 52*d* or may decrease at an even greater rate. Preferably, the radius of curvature ($r$3) of the surface 50*d* is much smaller than that of the adjacent portion 58*d* of the moldboard 22*d* so that a hook-shaped cross-sectional appearance results and the deflector portion 38*d* angles downwardly towards the plowed surface (FIG. 4). Alternatively, the radius of curvature ($r$4, $r$5) of the moldboard 22*e* decreases from edge 26*e* to edge 24*e* but the radius of curvature ($r$6) of the deflector portion 38 is equal to that of the immediately adjacent portion 58 of moldboard 22 ($r$5 in FIG. 5).

The angle of mounting the deflector portion 38 with respect to the surface 52 of moldboard 22 is also variable. In one embodiment the butt end 46 is mounted at a slight downward angle "F" with respect to the plowing surface 52*d* (FIG. 5). The desired angle is conveniently achieved by an appropriate bending of plates 40. In an alternate embodiment the butt end 46 is not angled with respect to the plowing surface 52, the deflector 30 continuing the curvature of the plowing surface 52 although its radius of curvature may or may not be different from the radius of curvature of the immediately adjacent portion of moldboard 22 (FIGS. 1 and 4). Generally, however, it is not preferred to angle the deflector portion 38 upwardly with respect to surface 52.

In use, the vehicle 12 moves forwardly in the direction of arrow "A" (FIG. 1) with the blade 14 oriented conventionally at a non-perpendicular angle with respect to the direction of forward movement. As snow is scraped by scraper plate 32, it moves upwardly along the forward plowing surface 52 in the direction of arrow "C" from the lower edge 26 to the upper edge 24 and laterally from the inlet end 34 to the discharge end 36 due to the funnel shape of the blade 14. The deflector 30 continues the curvature of the moldboard 22 augmenting the rolling or funneling action imparted to the snow (FIGS. 1–5). Thus, the snow is given a momentum in the direction of vehicle movement as it exits from the deflector 30, preferably including a downward component due to the curvature of the deflector 30 (FIG. 2) causing the snow to exit generally in the direction indicated by arrow "D". Since the deflector 30 extends well over the surface being plowed, the snow does not tend to billow or blow rearwardly obscuring the driver's vision. In addition, the increased length of the plow's effective working surface augments the funneling effect imparted to the snow causing it to move efficiently from the inlet end 34 to the discharge end 36.

When snow begins to build up on the plowing surface 52 of moldboard 22 due to a large snow accumulation or a high plowing speed, the resilient deflector portion 38 is deformed in a clockwise direction, for example in the direction indicated by arrow "E" (FIG. 4), with the greatest deflection occurring at the tip 48 and the least deflection occurring at the butt end 46. The extent of deflection of the portion 38 gradually diminishes from the tip 48 to the butt end 46 due to the tapered cross-sectional shape of the deflector portion 38. Thus, the deflector portion 38 adjusts its radius of curvature automatically to permit greater outward flow of snow when excessive congestion begins to occur along the blade 14. The deflection of the deflector portion 38 increases as the congestion increases and decreases, returning to its original configuration, as the congestion decreases. Since the deflector portion 38 is made of resilient material, these deflections do not initiate vibrations in the deflector 38 that are transmitted to the plow 16 because the resilient material dampens any such vibrations as well as any vibrations developed in the plow blade due to surface irregularities.

Thus, the curvature of the blade, the angle of mounting deflector portion 38, its radius of curvature with respect to that of plowing surface 52, the length of the deflector portion 38, its resiliency and its taper angle control the direction and rate of flow of snow along surface 52 of blade 14. The amount of snow directed upwardly that may blow towards the vehicle, obstructing its operator's vision, is also affected by these same factors. Therefore, by optimal adjustment of these factors for a given plow under given plowing conditions plowing efficiency and minimal snow blow back can be achieved.

Many modifications and variations of the present invention are possible in light of the above teaching. Thus, it is to be understood that, within the scope of the appended claims, the invention may be practiced otherwise than as specifically described above.

What is claimed and desired to be secured by Letters Patent of the United States is:

1. A snowplow deflector for attachment along the top edge of a moldboard of a vehicular snowplow comprising a tapered resilient strip having a butt end and a tip, and means for mounting said strip at its butt end along said top edge of said moldboard, said strip being adapted to be attached to said mounting means and being tapered along its length from said butt end to said tip, said strip generally having a larger thickness near said butt end than near said tip.

2. The deflector, as claimed in claim 1, wherein said strip is curved along its length between said butt end and said tip.

3. The deflector, as claimed in claim 2, wherein said strip has a hook-shaped cross-sectional configuration.

4. The deflector, as claimed in claim 2, wherein said mounting means comprises a pair of spaced apart elongated plates, said strip being adapted to be clamped between said pair of plates.

* * * * *

UNITED STATES PATENT AND TRADEMARK OFFICE

CERTIFICATE OF CORRECTION

PATENT NO. : 4,385,458

DATED : May 31, 1983

INVENTOR(S) : Vincent J. Patti

It is certified that error appears in the above-identified patent and that said Letters Patent are hereby corrected as shown below:

On the title page:

Please change the name of the inventor (both instances) from "Pitti" to --Patti--.

Signed and Sealed this

*Nineteenth* Day of *February 1985*

[SEAL]

*Attest:*

DONALD J. QUIGG

*Attesting Officer* *Acting Commissioner of Patents and Trademarks*